US006383229B2

(12) United States Patent
Entrekin et al.

(10) Patent No.: US 6,383,229 B2
(45) Date of Patent: May 7, 2002

(54) METHOD AND APPARATUS FOR CONTINUOUSLY CLEANING YARN FIBERS

(75) Inventors: Richard T. Entrekin, San Angelo, TX (US); Samsel K. Labrecque, Gainesville; Harvey Gordon Anderson, Toccoa, both of GA (US)

(73) Assignee: Ethicon, Inc., Somerville, NJ (US)

( * ) Notice: Subject to any disclaimer, the term of this patent is extended or adjusted under 35 U.S.C. 154(b) by 0 days.

(21) Appl. No.: 09/737,065

(22) Filed: Dec. 14, 2000

Related U.S. Application Data

(62) Division of application No. 09/163,562, filed on Sep. 30, 1998, now Pat. No. 6,170,302.

(51) Int. Cl.[7] ..... D06B 3/06
(52) U.S. Cl. ..... 8/151.2
(58) Field of Search ..... 8/151.2; 68/181 R, 68/200, 205 R; 134/64 R, 122 R; 28/254, 273

(56) References Cited

U.S. PATENT DOCUMENTS

| | | | | | |
|---|---|---|---|---|---|
| 2,360,352 | A | * | 10/1944 | Lodge | 68/200 X |
| 2,772,552 | A | * | 12/1956 | Nikles et al. | 68/181 R |
| 2,852,906 | A | | 9/1958 | Breen | 57/34 |
| 3,044,098 | A | * | 7/1962 | Stalson | 134/64 X |
| 3,097,412 | A | | 7/1963 | Becher | 28/1 |
| 3,462,813 | A | | 8/1969 | Dyer | 28/72 |
| 3,485,428 | A | | 12/1969 | Jackson | 226/97 |
| 3,545,057 | A | | 12/1970 | Lubach | 28/1.4 |
| 3,559,860 | A | | 2/1971 | East et al. | 226/97 |
| 3,577,614 | A | | 5/1971 | Price | 28/1.4 |
| 3,835,510 | A | | 9/1974 | Koslowski | 28/1.4 |
| 3,863,309 | A | | 2/1975 | Price | 28/1.4 |
| 3,881,231 | A | | 5/1975 | Price et al. | 28/1.4 |
| 3,969,799 | A | | 7/1976 | Polney | 28/1.4 |
| 3,979,805 | A | | 9/1976 | Hoffsommer et al. | 28/1.4 |
| 4,041,583 | A | | 8/1977 | Hart et al. | 28/254 |
| 4,064,884 | A | * | 12/1977 | Asp | 134/64 X |
| 4,095,319 | A | | 6/1978 | Nelson | 28/273 |
| 4,096,612 | A | | 6/1978 | Agers et al. | 28/272 |
| 4,099,308 | A | | 7/1978 | Wesley | 28/273 |
| 4,104,770 | A | | 8/1978 | Massey, Jr. et al. | 28/257 |
| 4,157,605 | A | | 6/1979 | Agers | 28/254 |
| 4,189,812 | A | | 2/1980 | Agers et al. | 28/272 |
| 4,259,768 | A | | 4/1981 | Clendening, Jr. et al. | 28/254 |
| 4,282,637 | A | | 8/1981 | Mosseri et al. | 28/254 |
| 4,290,177 | A | | 9/1981 | Price et al. | 28/254 |
| 4,492,009 | A | | 1/1985 | Agers et al. | 28/254 |
| 4,547,938 | A | | 10/1985 | Cullen et al. | 28/254 |
| 4,574,436 | A | | 3/1986 | Cullen, Jr. | 28/254 |
| 4,807,431 | A | | 2/1989 | Braxmeier | 57/333 |
| 4,811,748 | A | * | 3/1989 | Murao et al. | 134/122 R |
| 4,945,618 | A | | 8/1990 | Gorrafa | 28/254 |
| 5,020,199 | A | | 6/1991 | Gorrafa | 28/273 |
| 5,140,729 | A | | 8/1992 | Simmen | 28/271 |
| 5,184,381 | A | * | 2/1993 | Coons, III et al. | 28/273 X |
| 5,231,743 | A | | 8/1993 | Goldstein | 28/272 |

FOREIGN PATENT DOCUMENTS

| | | | | |
|---|---|---|---|---|
| SU | 820916 | * | 4/1981 | 134/122 R |

* cited by examiner

*Primary Examiner*—Philip Coe

(57) ABSTRACT

A method and apparatus for continuously cleaning a yarn moving through the device. A first scouring body has a yarn entrance and a yarn exit connected by a central cavity. Pressurized fluid is introduced through the yarn while the yarn is positioned within and moving through the central cavity.

4 Claims, 4 Drawing Sheets

METHOD AND APPARATUS FOR CONTINUOUSLY CLEANING YARN FIBERS

Divisional of prior application No.: 09/163,562, filed Sep. 30, 1998, now U.S. Pat. No. 6,170,302.

FIELD OF THE INVENTION

This invention relates to a device for continuously cleaning yarn and more specifically, for removing lubricants and contaminants during the processing of fibers used to make surgical sutures.

BACKGROUND OF THE INVENTION

The removal of processing lubricants and associated contaminants is a significant aspect in the processing of surgical ligatures such as braided sutures, woven tapes and yarns. The difficulty in cleaning the surgical ligatures stems from the fact that the contaminants and lubricants can be trapped between the individual filaments of the yarn bundle in these surgical ligatures. In order to clean the ligature, a cleaning agent or solvent must permeate the crevices between the filaments of the yarn bundle. Typically, surgical ligatures have been cleaned by various batch methods, where the ligature is immersed in a bath for a predetermined amount of time sufficient to remove lubricants and contaminants from the fibers.

The present invention provides a solution to the above-mentioned problem by providing a device that continuously cleans yarn fibers, and which does not require any stoppage or interruption in the yarn manufacturing process in order to clean such ligatures.

Venturi devices, such as that disclosed in U.S. Pat. Nos. 3,097,412; 3,462,813; 3,545,057; 3,577,614; 3,863,309; 3,881,231; 3,969,799; 3,979,805; 4,041,583; 4,096,612; 4,104,770; 4,157,605; 4,189,812 and 4,290,177; all incorporated herein by reference, have been used for texturizing yarns, but not for cleaning lubricants and contaminants from yarns.

It is therefore an object of the present invention to provide a device for continuously cleaning a ligature.

Another object of the present invention is to provide a device for removing lubricants and contaminants during the processing of surgical ligatures.

Still another object of the present invention is to provide a method for continuously cleaning surgical ligatures moving through a device.

A further object of the invention is to provide a method for removing lubricants and contaminants during the processing of surgical ligatures.

These and other objects and advantages of the invention will become more fully apparent from the description and claims, which follow or may be learned by the practice of the invention.

SUMMARY OF THE INVENTION

The present invention is directed to a method and apparatus for continuously cleaning a surgical ligature moving through the device. A first scouring body has a yarn entrance and a yarn exit connected by a central cavity. Moving fluid is introduced through the surgical ligature while the surgical ligature is positioned within and moving through the central cavity.

In a particularly preferred embodiment, a device in accordance with the present invention further comprises an inlet in fluid communication with the central cavity of the scouring body, and a venturi situated within the central cavity. The venturi is preferably positioned at the exit. The venturi devices listed in the background, and incorporated by reference, would all be used in the present invention. In one preferred embodiment, a needle is slidably mounted into the central cavity through the entrance of the venturi. The needle includes a passage there through for introducing ligature through the central cavity and, at least one flange and a cap. The flange of the needle has at least one opening to allow movement of the fluid from the solvent inlet to the central cavity. This preferred device further comprises at least one cover for holding the needle securely within the central cavity of the scouring body and at least one adjustment nut for adjusting movement of the needle within the central cavity. The cover is in direct contact with the adjustment nut. The device also preferably includes ceramic eyelets situated adjacent to the entrance of the scouring body. In an alternative preferred embodiment, the cleaning device has a baffle for guiding the ligature. The baffle is slidably mounted on a bracket affixed to the scouring body at the exit. A turning pin may also be provided for holding the baffle in the bracket. The entrance and exit are preferably located on opposing sides of the scouring body.

A ligature cleaning system in accordance with the present invention preferably includes two of the scouring bodies described above. Like the first scouring body, the second scouring body has a entrance and exit connected by a central cavity and a means for introducing fluid through the ligature while the ligature is positioned within and moving through the central cavity of the second scouring body. The first and second scouring bodies are arranged in tandem. Each of the first and second scouring bodies has an axis defined by its entrance and exit. The axis of the first and second scouring bodies can be co-axially aligned along a common axis when the system is in its thread-up state. The axes of the first and second scouring bodies are then aligned at a non-zero angle in order to bring the system into a scouring state. The angle between the axes of the first and second scouring bodies is from about 45° to about 90°. When the system is used to clean thinner ligature, the non-zero angle varies from about 60° to about 75°. Separation of the liquid stream containing contaminants and lubricants from the ligature fiber occurs when the ligature fiber is guided away from the exit of a scouring body at an angle. A plurality of scouring bodies can be aligned to continuously clean surgical ligatures.

The ligature cleaning system can also include a housing for encasing a scouring body and a rotatable mounting device for attaching the scouring body within the housing. The housing comprises eyelets for introducing and removing ligature. The housing can also include a fume hood for removing vapors emitted by the cleaning fluid.

The device of the present invention can also comprise a fluid reservoir and a connecting means for transporting solvent from the reservoir to a scouring body. The preferred cleaning fluid is ethyl acetate and the ligature fiber is a suture strand.

The present invention also relates to a method of continuously cleaning a ligature moving through a device. The method comprises the following steps: (a) guiding ligature through a scouring body having a entrance and exit connected by a central cavity, and (b) introducing fluid through ligature positioned within and moving through the central cavity. Before employing step (a), a needle can be slidably mounted into the central cavity and the ligature can be introduced into the central cavity using a needle. After the needle is mounted, the movement of the needle can be adjusted with an adjustment nut. Before employing step (b), the ligature can be moved through a second scouring body having entrance and exit connected by a central cavity, and then the first and second scouring bodies can be aligned at a non-zero angle. The angle between the first and second bodies can vary from about 45° to about 90°.

The method of the present invention can also include the following steps of: (a) axially aligning at least two scouring bodies during a thread-up state; (b) guiding ligature through the central cavity of the scouring bodies utilizing an axially slidable needle; (c) rotatably adjusting the scouring bodies creating a non-zero angle; and (d) introducing fluid through the central cavities of the scouring bodies while moving the ligature through the central cavities of the scouring bodies, thereby cleaning the ligature of contaminants and undesired lubricants during a scouring state.

BRIEF DESCRIPTION OF THE DRAWINGS

In order that the manner in which the above-recited and other advantages and objects of the invention are obtained and can be appreciated, a more particular description of the invention briefly described above will be rendered by reference to a specific embodiment thereof which is illustrated in the appended drawings. Understanding that these drawings depict only a typical embodiment of the invention and are not therefore to be considered limited of its scope, the invention and the presently understood best mode thereof will be described and explained with additional specificity and detail through the use of the accompanying drawings.

DETAILED DESCRIPTION OF THE PREFERRED EMBODIMENTS

Figure 1:
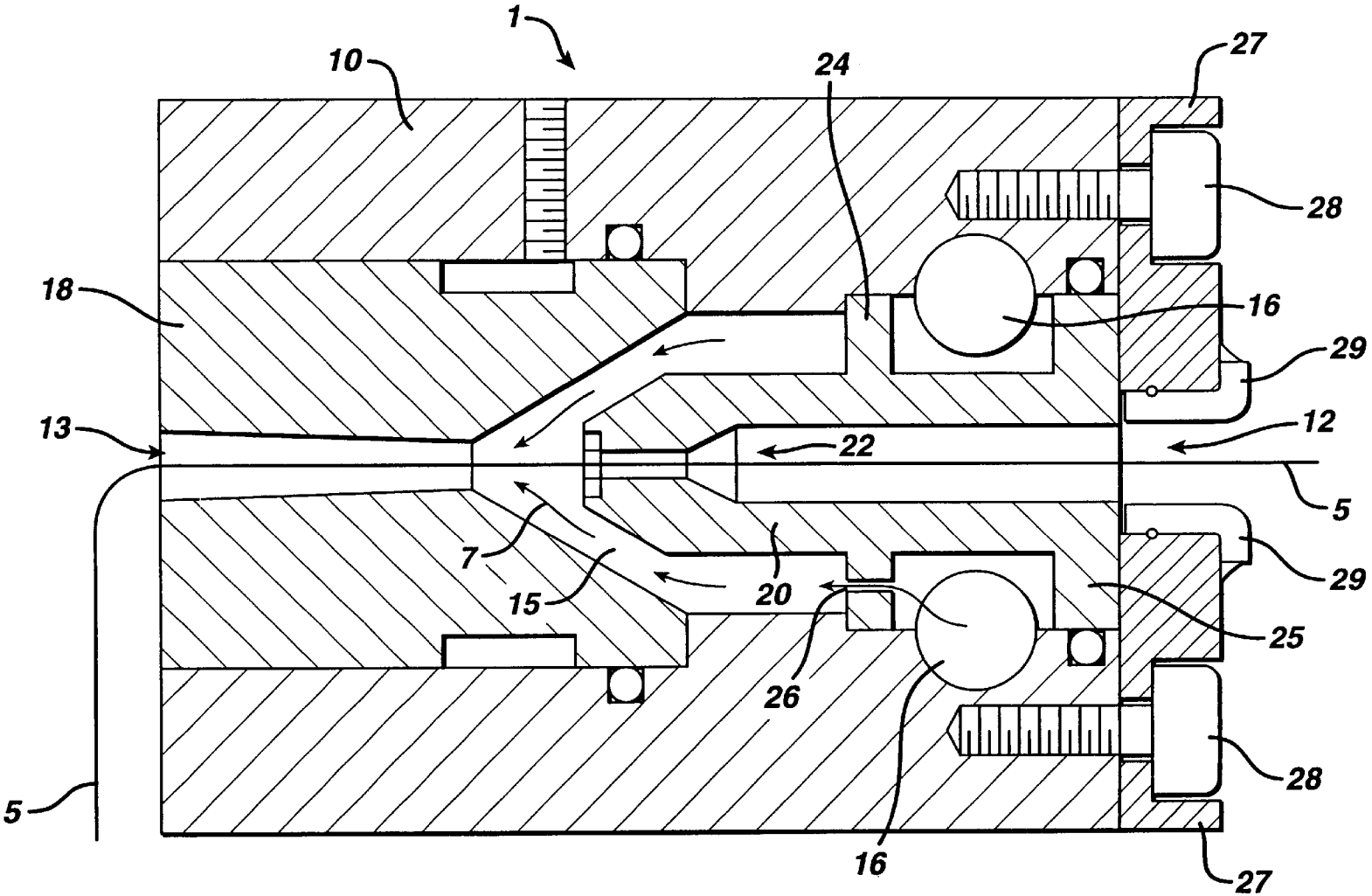
FIG. 1 is a cross-sectional view of a scouring body for continuously cleaning a surgical ligature as it travels through the central cavity of the scouring body, in accordance with a preferred embodiment of the present invention.
Figure 4:
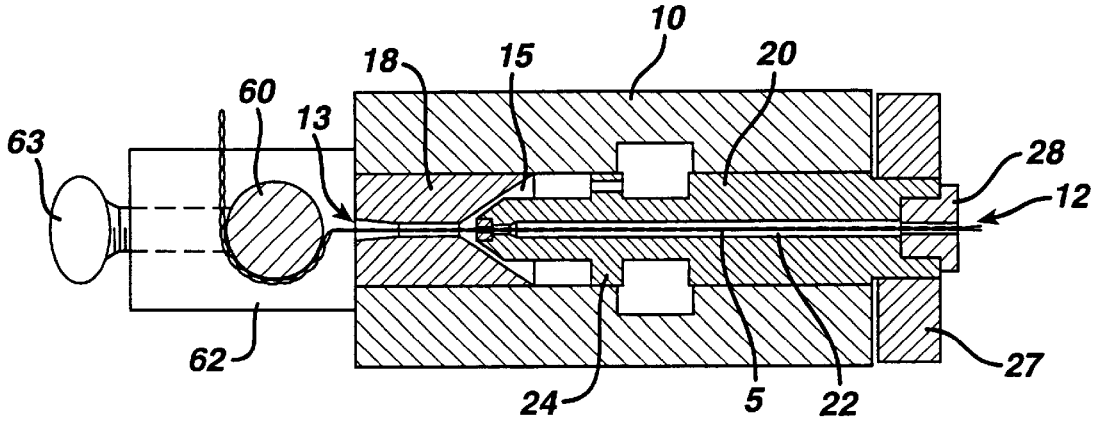
FIG. 4 is a cross-sectional view showing a baffle fixed with relation to the exit of a scouring body, in accordance with another preferred embodiment of the present invention.
Figure 5:
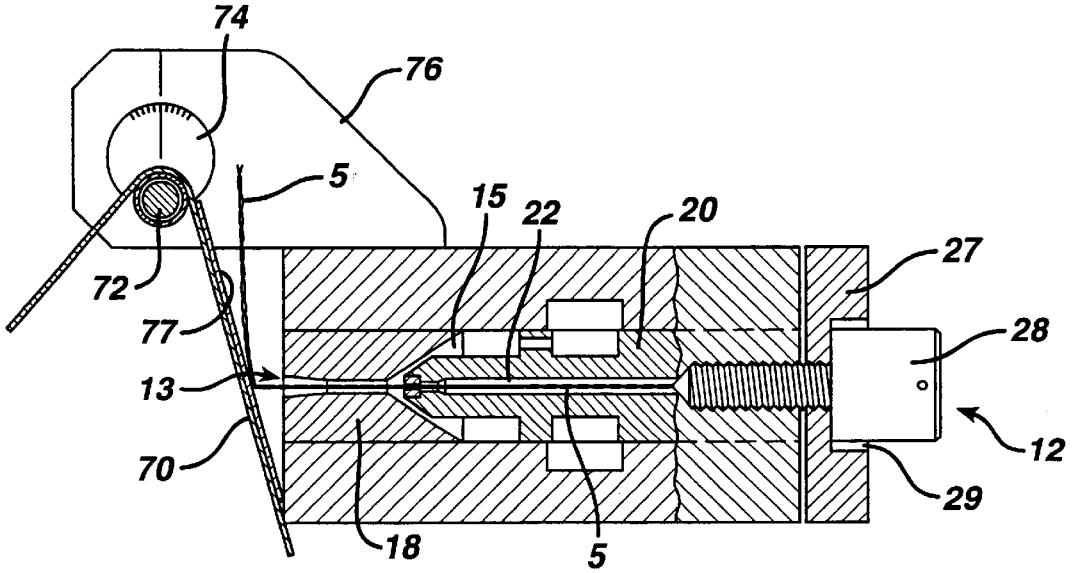
FIG. 5 is a cross-sectional view showing a baffle free to seek a force balance position with respect to the exit of a scouring body, in accordance with another preferred embodiment of the present invention.

Referring to the drawings wherein like reference numerals designate identical or corresponding parts throughout the several views, and more particularly, to FIGS. 1, 4 and 5 wherein a ligature cleaning device in accordance with the present invention, generally designated 1, comprises a scouring body 10 having an entrance 12 and an exit 13 connected by a central cavity 15. The device 1 further comprises an inlet 16 in fluid communication with the central cavity 15, and a venturi 18 situated within the central cavity 15 near the exit 13. The cleaning device 1 also has a needle 20 slidably mounted into the central cavity 15 through the entrance 12; the needle 20 has a passage 22 therethrough for introducing ligature 5 through the central cavity 15. The needle 20 has at least one flange 24 and a cap 25. The flange 24 of the needle 20 has at least one opening 26 for allowing movement of fluid 7 from the inlet 16 to the central cavity 15. The device further comprises at least one cover 27 for holding the needle 20 securely within the central cavity 15, and at least one adjustment nut 28 for adjusting the position of the needle 20 within the central cavity 15. The cover 27 is in direct contact with the adjustment nut 28. The device can also have ceramic eyelets 29 for protecting the ligature 5; the eyelets 29 are situated adjacent to the entrance 12 of the scouring body 10.

Figure 2:
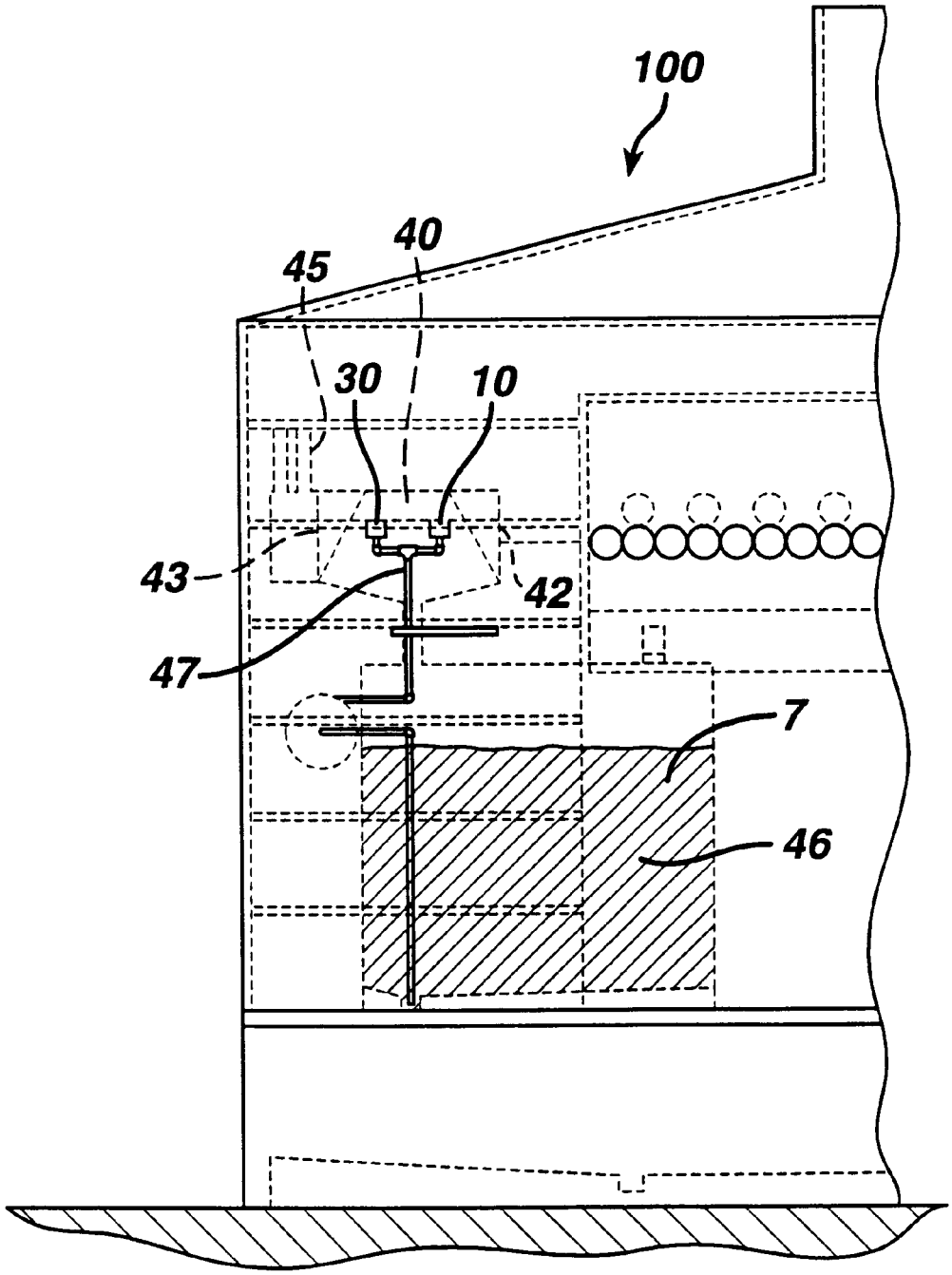
FIG. 2 is a diagram showing the operation of an overall system for cleaning surgical ligature, in accordance with a preferred embodiment of the present invention.

FIG. 2 shows an overall system 100 for cleaning a surgical ligature. System 100 includes a second scouring body 30 which is substantially the same as scouring body, and thus includes an entrance 32 and an exit 33 connected by a central cavity. The first and second scouring bodies, 10 and 30 respectively, rotatably mounted within and are encased by the housing 40. The housing 40 comprises eyelets 42 and 43 for introducing and removing ligature 5 from housing 40. The housing 40 also has a fume hood 45 for removal of toxic gases emitted by the fluid 7. The system 100 also has a fluid reservoir 46 and a connecting means 47 for transporting fluid 7 from the reservoir 46 to the scouring bodies, 10 and 30, respectively.

Figure 3A:
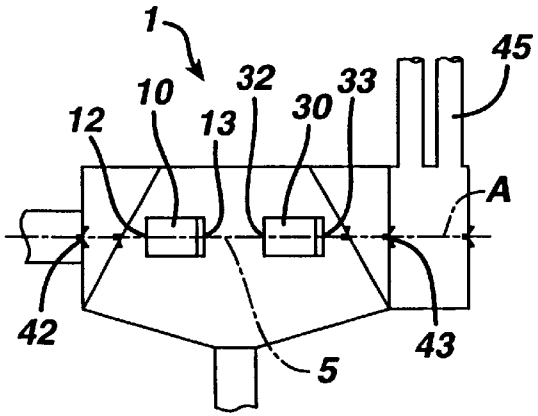
FIG. 3*a* is a diagram showing two scouring bodies in a thread-up position.

FIGS. 3*a, b* and *c* show system 100 in a thread-up position and scouring positions. The thread-up position is used to thread ligature 5 through device 100 prior to the initiation of cleaning or scouring s operations. In the thread-up position (FIG. 3*a*), the yarn entrances and exits of the first and second scouring bodies, 10 and 30 respectively, are rotated until they are aligned along a common axis A within a housing 40. The housing 40 has eyelet entrance 42 for introducing and removing ligature 5. During the thread-up operation, the ligature 5 is guided from the eyelet entrance 42 of the housing 40 to the entrance 12 of the first scouring body 10 through its central cavity 15 and out its exit 13. The yarn is then introduced to the entrance 32 of the second scouring body 30 through its central cavity 35 and out its exit 33 and through the eyelets exit 43 of the housing 40.

Figure 3B:
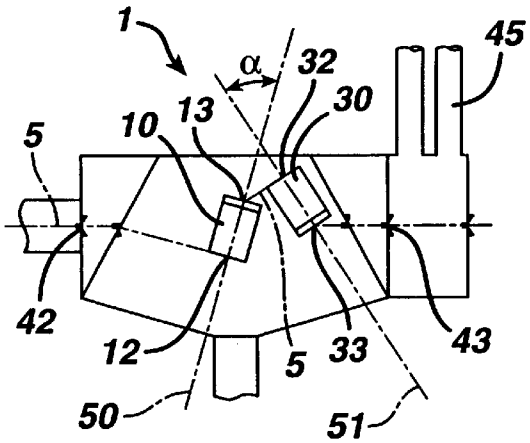
FIGS. 3*b* and *c* are diagrams showing scouring bodies in different scouring positions, in accordance with alternative preferred embodiments of the present invention.
Figure 3C:
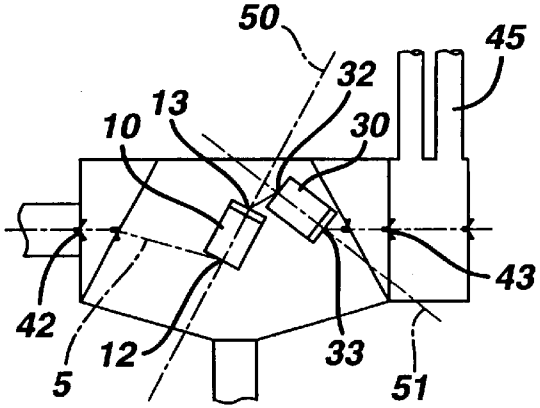

FIGS. 3*b* and *c* show the scouring bodies, 10 and 30 respectively, in different scouring positions. After the thread-up operation is complete, scouring bodies 10 and 30 are then preferably rotated until they are aligned in one of the scouring positions shown in FIGS. 3*b* and 3*c*. Each of the first and second scouring bodies, 10 and 30, has an axis 50 or 51, defined by a line passing through its entrance, 12 or 32, and its exit, 13 or 33. In the scouring positions shown, the axes of the first and second scouring bodies, 50 and 51, are aligned at a non-zero angle. The angle (a) between the axis of the first and second bodies is from about 45° to about 90°, and may be varied depending on the thickness of the yarn suture. For example, FIG. 3*b* shows a scouring used for cleaning thicker (i.e., 3 to 0 braided suture) ligature, and FIG. 3*c* shows a scouring position used for thinner (i.e., 1/0 to 8/0 braided suture) ligature. The scouring position in FIG. 3 is preferred for thinner ligatures because the angle of ligature 5 relative to axes 51 and 52 is smaller, thus creating less tension on the ligature and minimizing the likelihood of breaking or damaging the ligature.

In accordance with an alternative preferred embodiment, FIG. 4 shows a cross-section of the device 1 with a baffle 60 installed adjacent to the venturi 18 and the exit 13 in accordance with the teachings of Breen, U.S. Pat. No. 2,852,906 incorporated herein by reference. The baffle 60 is slidably mounted in bracket 62, which in turn is affixed to the scouring body 10 at the exit 13. A turning pin 63 holds the baffle 60 in place in the bracket 62 and when released, the baffle 60 can be moved from the exit end of the device 1 for ease of thread-up.

In accordance with an alternative preferred embodiment, FIG. 5 shows the cleaning device 1 with a baffle 70 movable about a hinge pin 72 according to the teachings of Kozlowski, U.S. Pat. No. 3,835,510, incorporated herein by reference. Hinge pin 70 is mounted off-center of cylinder 74, which is rotatable in bracket 76, which is attached to the scouring body 10. A knob (not shown) is used to rotate cylinder 74, thus providing an eccentric motion for varying the position of the baffle 70 for optimum operating conditions. A layer of wear-resistant ceramic material 77 may be attached to the surface of baffle 70 facing the outlet end of the device 1.

To thread-up the device 1, ligature 5 is presented to the entrance 12 of the device 1 with the assistance of the needle 20. The cover 27 is moved inwardly away from the head of the adjustment nut 28, from a preset operating position to a string-up position so that an aspirating effect draws the ligature 5 through the entrance 12 and out through the passage 22. When the ligature 5 emerges from the venturi 18, the cover 27 is allowed to return to its preset operating position against the adjustment nut 28 under the force of pressure against the needle 20 in the reduced region of the yarn needle. In this manner, pressure in communication with piston and cylinder arrangement of the needle 20 and scouring body 10 in the central cavity is relied on to return the needle 10 back to the present operating position after string-up. The ligature is then guided through the venturi and out of the device 1 at an angle. Once thread-up is complete, pressurized fluid 7 is then introduced from the inlet 16 to the central cavity 15, thus cleaning the ligature 5 positioned within and moving through the central cavity of the scouring body 10.

For the purpose of this invention, a surgical ligature includes yarns, braided constructs and woven or knitted tapes. The fluid used to clean the ligatures should be an appropriate liquid to remove the desired contaminants and/or clean the ligature. Generally the fluids will be cleaning solutions (detergents, surfactants, emulsifiers, wetting agents and combinations thereof) or solvents (i.e., ethyl acetate, acetone, toluene, trichloroethane, water and/or steam). If absorbable sutures are being cleaned aqueous cleaning solutions should be avoided. The fluids used to clean the ligatures may be applied at elevated temperature to facilitate cleaning.

Additionally, the present invention can be combined with conventional ligature cleaning techniques such as scouring baths (which have moving fluids or agitation such as mechanical, sonic or ultrasonic) and/or rinsing procedures. The present invention may be combined with other conventional post cleaning steps such as drying, heat stretching, coating, sterilization and packaging.

Obviously, numerous modifications and variations of the present invention are possible in light of the above teachings. It is therefore understood that within the scope of the appended claims is appended hereto, the invention may be practiced otherwise than as specifically disclosed herein.

What is claimed is:

1. A method for continuously cleaning a ligature moving through a device, said device comprising a first scouring body having an entrance and an exit connected by a central cavity, the process comprising the ordered steps of:

(a) slidably mounting a needle into said central cavity of said first scouring body, and introducing said ligature into said central cavity through said needle, (b) threading said ligature through a second scouring body having a second entrance and second exit connected by a central cavity, and then aligning the first and second scouring bodies at a non-zero angle, (c) continuously moving said ligature through said central cavity of said first and said second scouring bodies;

(d) introducing pressurized fluid through said ligature while said ligature is positioned within and continuously moving through said central cavity of said first and second scouring bodies.

2. The method of claim 1, further comprising the step of after mounting said needle, adjusting said needle within said central cavity with an adjustment nut.

3. The method of claim 1 wherein the non-zero angle is from 45° to 90°.

4. A method for continuously cleaning a ligature moving through a device, comprising the steps of:

axially aligning at least two scouring bodies in a thread-up state, each scouring body having a central cavity;

guiding said ligature through said central cavities of said scouring bodies utilizing an axially slidable needle;

rotatably adjusting said scouring bodies to create a non-zero angle between said scouring bodies; and introducing pressurized fluid through said central cavities of said scouring bodies while simultaneously moving said ligature through said central cavities of said scouring bodies during a scouring state.

* * * * *